US006857242B2

(12) United States Patent
He

(10) Patent No.: US 6,857,242 B2
(45) Date of Patent: Feb. 22, 2005

(54) CUSHION BLOCK FOR BUILD-UP SURFACE MADE BY STRIPS

(75) Inventor: Jun-Jie He, Shentzuen (CN)

(73) Assignees: Jacky Chih-Kun Hong, Changhua (TW); David Li-Chu Hsu

( * ) Notice: Subject to any disclaimer, the term of this patent is extended or adjusted under 35 U.S.C. 154(b) by 0 days.

(21) Appl. No.: 10/411,296

(22) Filed: Apr. 11, 2003

(65) Prior Publication Data

US 2003/0192275 A1 Oct. 16, 2003

(30) Foreign Application Priority Data

Apr. 13, 2002 (CN) ..... 02232302 U

(51) Int. Cl.[7] ..... E04B 2/08
(52) U.S. Cl. ..... 52/589.1; 52/480
(58) Field of Search ..... 52/511, 403.1, 52/582.1, 586.1, 589.1, 592.1, 480; 428/56

(56) References Cited

U.S. PATENT DOCUMENTS 5,369,927 A * 12/1994 Counihan ..... 52/403.1
6,484,466 B2 * 11/2002 Chun et al. ..... 52/478
6,550,206 B2 * 4/2003 Lee ..... 52/480
6,564,522 B1 * 5/2003 Chiu-Ying ..... 52/480
6,666,244 B2 * 12/2003 Watanabe ..... 144/344
6,675,545 B2 * 1/2004 Chen et al. ..... 52/586.1

FOREIGN PATENT DOCUMENTS

NO EP-455616 A1 * 6/1991 ..... 52/480

* cited by examiner

*Primary Examiner*—Anita King
*Assistant Examiner*—Jon Szumny
(74) *Attorney, Agent, or Firm*—Browdy and Neimark, P.L.L.C.

(57) ABSTRACT

A cushion block for using in a build-up surface formed by strips has two male coupling devices at one end, two female coupling devices at an opposite end corresponding to the male coupling devices, a retaining device protruded from one side thereof and adapted to secure the strip to the corresponding side of the cushion block, and a deformable body connected between the male coupling devices and the female coupling device. The male and female coupling devices are so made such that multiple cushion blocks are connectable in a line in a linking direction by engaging the male coupling devices of one cushion block into the female coupling devices of another. The deformable body is deformable in the linking direction to compensate expansion of the strips due to absorption of moisture.

10 Claims, 5 Drawing Sheets

CUSHION BLOCK FOR BUILD-UP SURFACE MADE BY STRIPS

BACKGROUND OF THE INVENTION

1. Field of the Invention

The present invention relates generally to construction materials for upholstery and, more specifically, to a kind of cushion blocks for use in setting a build-up surface, such as wooden flooring, wooden wall or wooden ceiling.

2. Description of the Related Art

Build-up wooden flooring is commonly seen in upholstery. When paving a build-up wooden flooring, wooden strips coupled to one another by engaging the coupling flange of one wooden strip into the coupling groove of another wooden strip and then the flooring board thus obtained is fastened to the floor wall or wooden racks at the floor wall by iron nails. This wooden flooring paving procedure is complicated and time-consuming. Further, the nailing work requires a special technique. Only an experienced person can do the job well. Because wooden strips are fixedly fastened to the floor wall or wooden racks by iron nails and abutted against one another, they cannot expand freely. Therefore, the wooden strips tend to curve upwards or to break when absorbed a certain amount of moisture from the air. Recently, bamboo strips are popularly invited for flooring. However, bamboo strips have relatively higher absorptive power than wooden strips. The curving or breaking problem due to absorption of moisture will occur more easily in bamboo strips.

SUMMARY OF THE INVENTION

It is one object of the present invention to provide a cushion block for a build-up flooring, wall, ceiling and the like which is easy to install without special techniques and, saves much flooring cost.

It is another object of the present invention to provide a cushion block for a build-up flooring, wall, ceiling and the like which compensates the expansion of wooden strips due to absorption of moisture.

To achieve these objects of the present invention, the cushion block comprises a first coupling device at one end thereof, a second coupling device at an opposite end thereof corresponding to the first coupling device, the first coupling device and the second coupling device being made such that multiple cushion blocks are connectable in a line in a linking direction by engaging the first coupling device of one cushion block into the second coupling device of another cushion block, a retaining device protruded from one side thereof and adapted to secure strips to the corresponding side of the cushion block, and a deformable body connected between the first coupling device and the second coupling device and deformable in the linking direction to compensate expansion of strips due to absorption of moisture.

DETAILED DESCRIPTION OF THE INVENTION

Figure 1:
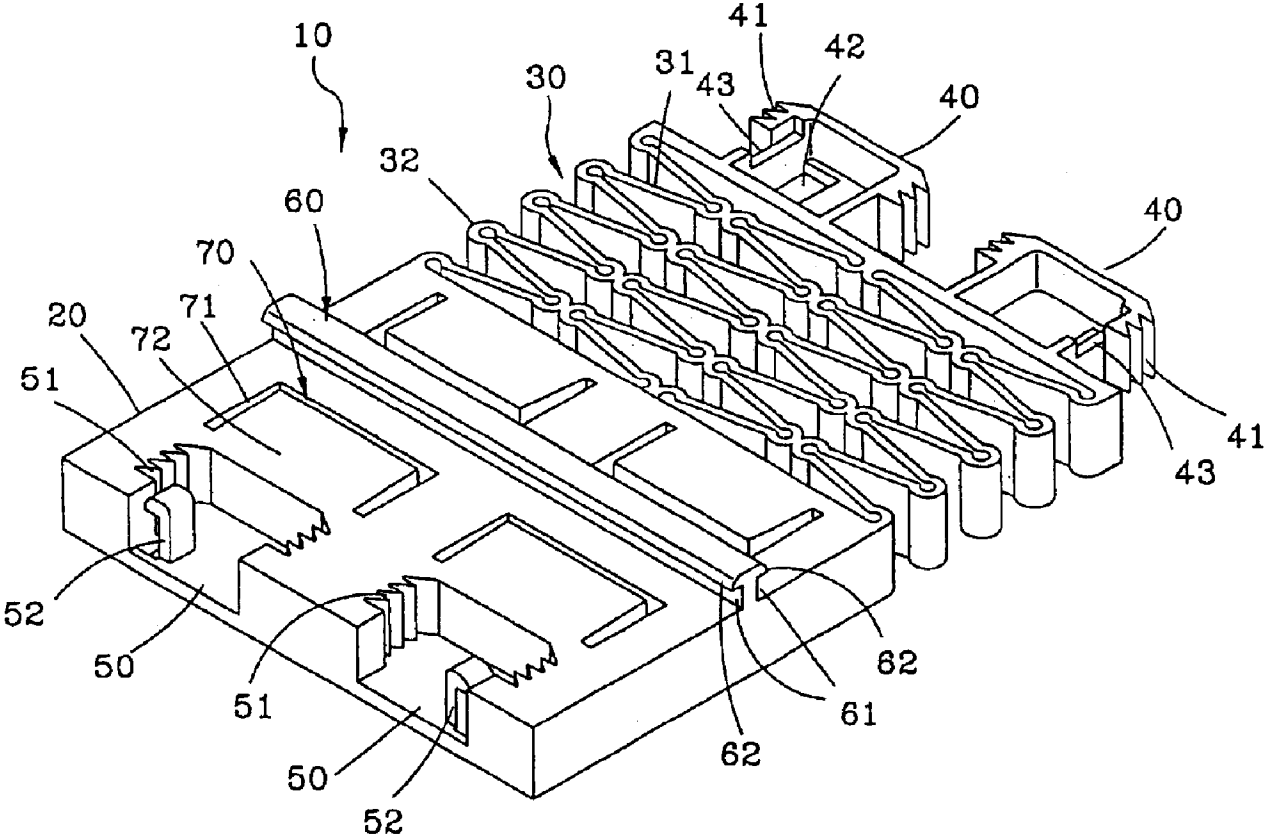
FIG. 1 is a perspective view of a cushion block according to a preferred embodiment of the present invention.
Figure 2:
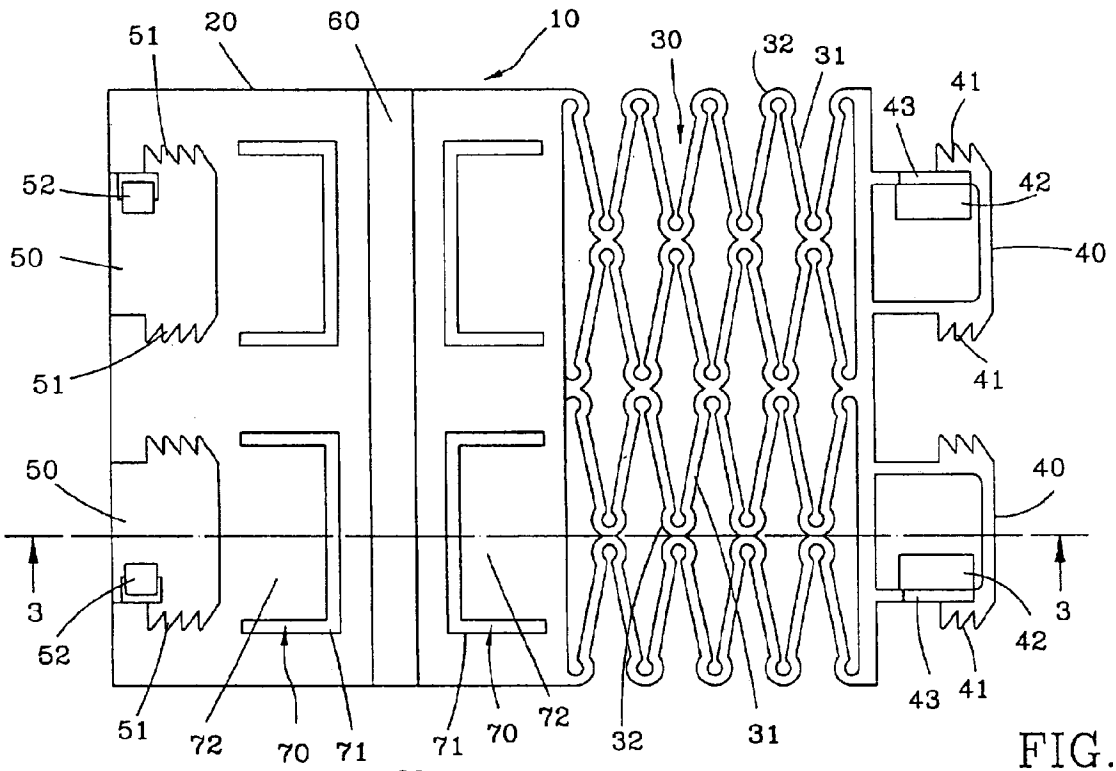
FIG. 2 is a top plain view of the cushion block according to the preferred embodiment of the present invention.

Referring to FIG. 1, a cushion block 10 is a flat rectangular block molded from synthetic resin (for example, polyacrylic resin or polyethylene resin) in integrity, having a base 20 disposed at one end, two male coupling devices 40 arranged in parallel at the other end, a deformable body 30 connected between the base 20 and the male coupling devices 40, two female coupling devices 50 arranged in parallel in an outer side of the base 20 remote from the deformable body 30, a retaining device 60 located on the top side of the base 20 and spaced between the deformable body 30 and the female coupling devices 50, and two pairs of springy supporting devices 70 located on the top side of the base 20 and symmetrically disposed at two sides of the retaining device 60.

The retaining device 60 projects upwards from the top side of the base 20. Except the retaining device 60, the top sides of the other parts of the cushion block 10 are maintained in flush (the springy supporting devices 70 are normally disposed in a sloping position partially protruding over the top side of the base 20, however they become flush with the top side of the base 20 when forced downwards).

According to the present preferred embodiment, the thickness of the cushion block 10 is about 1 cm (the height of the protruding retaining device 60 excluded). The length of the cushion block 10 (i.e., the length front the outer end of the male coupling device 40 to the outer end of the female coupling devices 50) is about 10 cm. The width of the cushion block 10 is about 7 cm. For easy understanding of the present invention, the direction passing through the male coupling devices 40 and the female coupling devices 50 is defined as "linking direction".

The base 20 is shaped like a flat rectangular block. The deformable body 30 extends outwards from one vertical peripheral side of the base 20 to the male coupling devices 40 opposite to the female coupling devices 50, and is formed of a latticed grid having rhombic meshes 31 in it. Each rhombic mesh 31 has two opposite acute angles aligned in the linking direction, and two opposite obtuse angles aligned in a direction across the linking direction. Further, Each acute angle of each rhombic mesh 31 forms a substantially C-shaped arched portion 32 having the open side facing the inside of the respective rhombic mesh 31. Because of the latticed grid structural design, the deformable body 30 can be compressed and stretched in the linking direction. Further, the deformable body 30 does not wear easily with use because it is molded from synthetic resin.

The male coupling devices 40 are respectively outwardly extended from one side of the deformable body 30 remote from the base 20, each having three vertical positioning ribs 41 symmetrically disposed at two sides, a vertical through hole 42, and a retaining notch 43 disposed at an outer side at a lower elevation than the top side of the cushion block 10.

The female coupling devices 50 are recessed coupling devices formed in the side of the base 20 and extended to one vertical peripheral side of the base 20 opposite to the deformable body 30 and adapted to accommodate the male coupling devices 40 respectively, each having four vertical positioning grooves 51 symmetrically disposed at two sides, and an upright springy hook 52 adapted to engage the retaining notches 43 of the male coupling devices 40.

The retaining device 60 is an elongated retaining bar raised from the top side of the base 20 and extending across the linking direction between two opposite vertical peripheral sides of the base 20. The cross section of the retaining device 60 is a T-shaped cross section, i.e., the retaining device 60 has an elongated top flange 62, defining two elongated coupling grooves 61 at two sides below the top flange 62.

Figure 3:
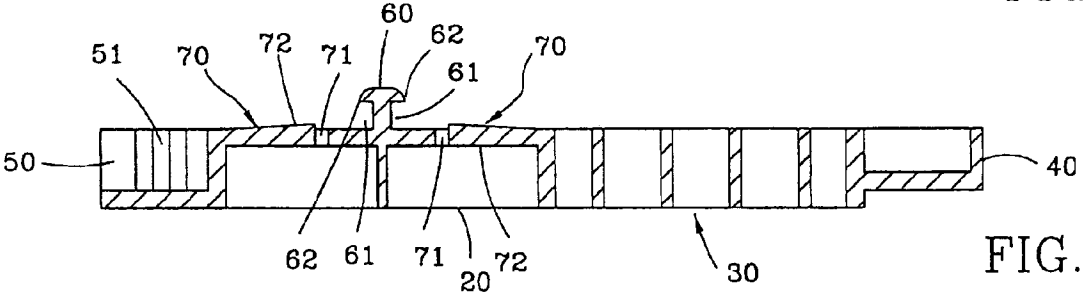
FIG. 3 is a sectional view taken along line 3—3 of FIG. 2.

The bottom side of the base 20 is a hollow structure (see FIG. 3). Two springy tongues 72 are formed of a part of the top wall of the base 20 by making two substantially U-shaped crevices 71 in the top wall of the base 20 at two sides of the retaining device 60. The top side of each springy tongue 72 obliquely upwardly extends from the fixed end toward the free end (see FIG. 3). The crevices 71 and the springy tongues 72 form the aforesaid springy supporting devices 70.

Figure 4:
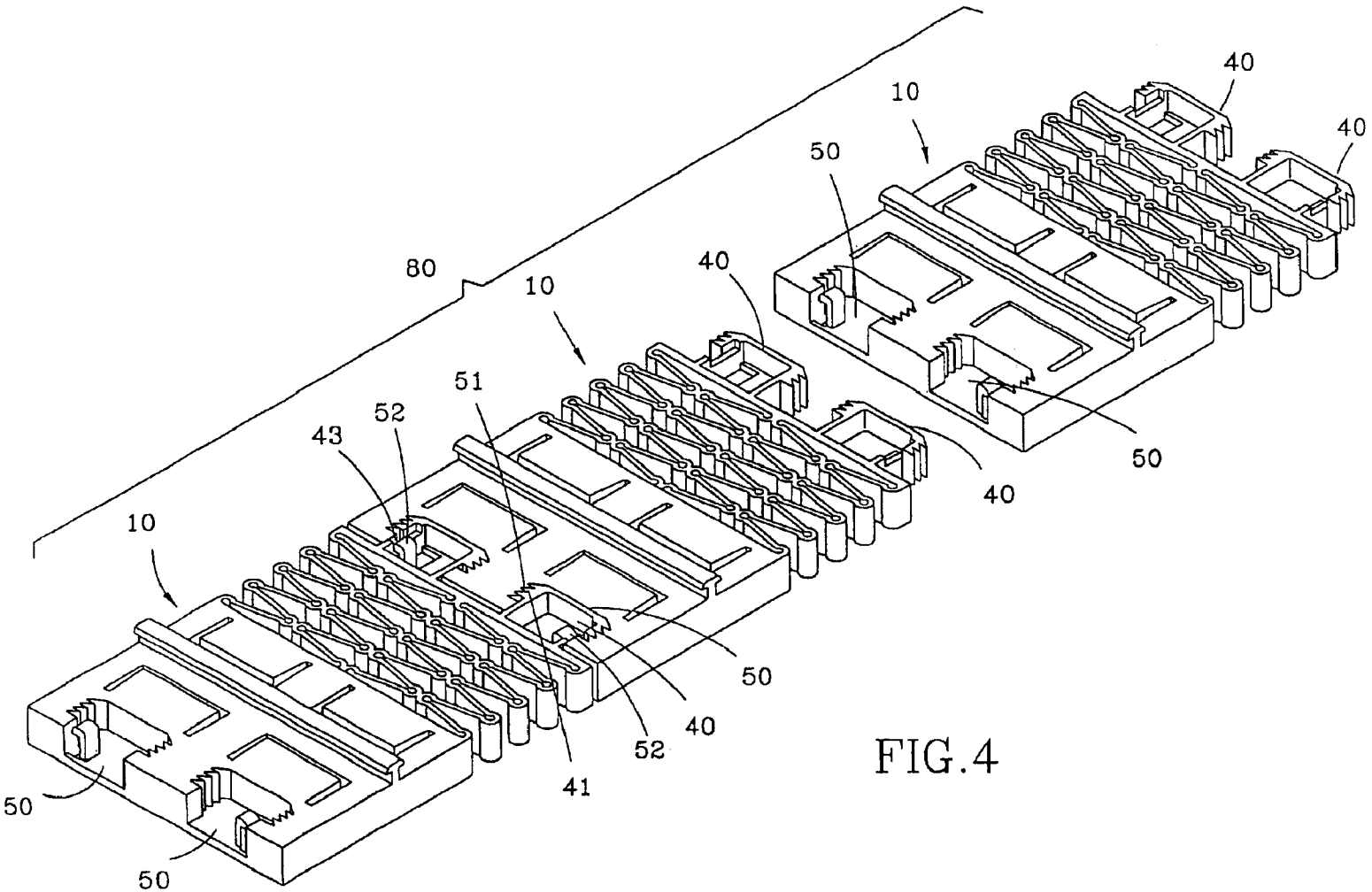
FIG. 4 illustrates the connection of multiple cushion blocks according to the preferred embodiment of the present invention.

Referring to FIG. 4, by means of fastening the male coupling devices 40 of one cushion block 10 to the female coupling devices 50 of another, a plurality of cushion blocks 10 are connected in a series, forming an elongated rack 80 for supporting wooden strips. When fastening the male coupling devices 40 of one cushion block 10 to the female coupling devices 50 of another, the three vertical positioning ribs 41 at one side of each male coupling device 40 can selectively be forced into engagement with the front three or rear three of the corresponding four vertical positioning grooves 51 of the matching female coupling device 50. Therefore, each two cushion blocks 10 can be alternatively connected between two sizes. After insertion of the respective male coupling devices 40 into the respective female coupling devices 50, the upright springy hooks 52 of the respective female coupling devices 50 are respectively hooked in the retaining notches 43 of the respective male coupling devices 40.

Figure 5:
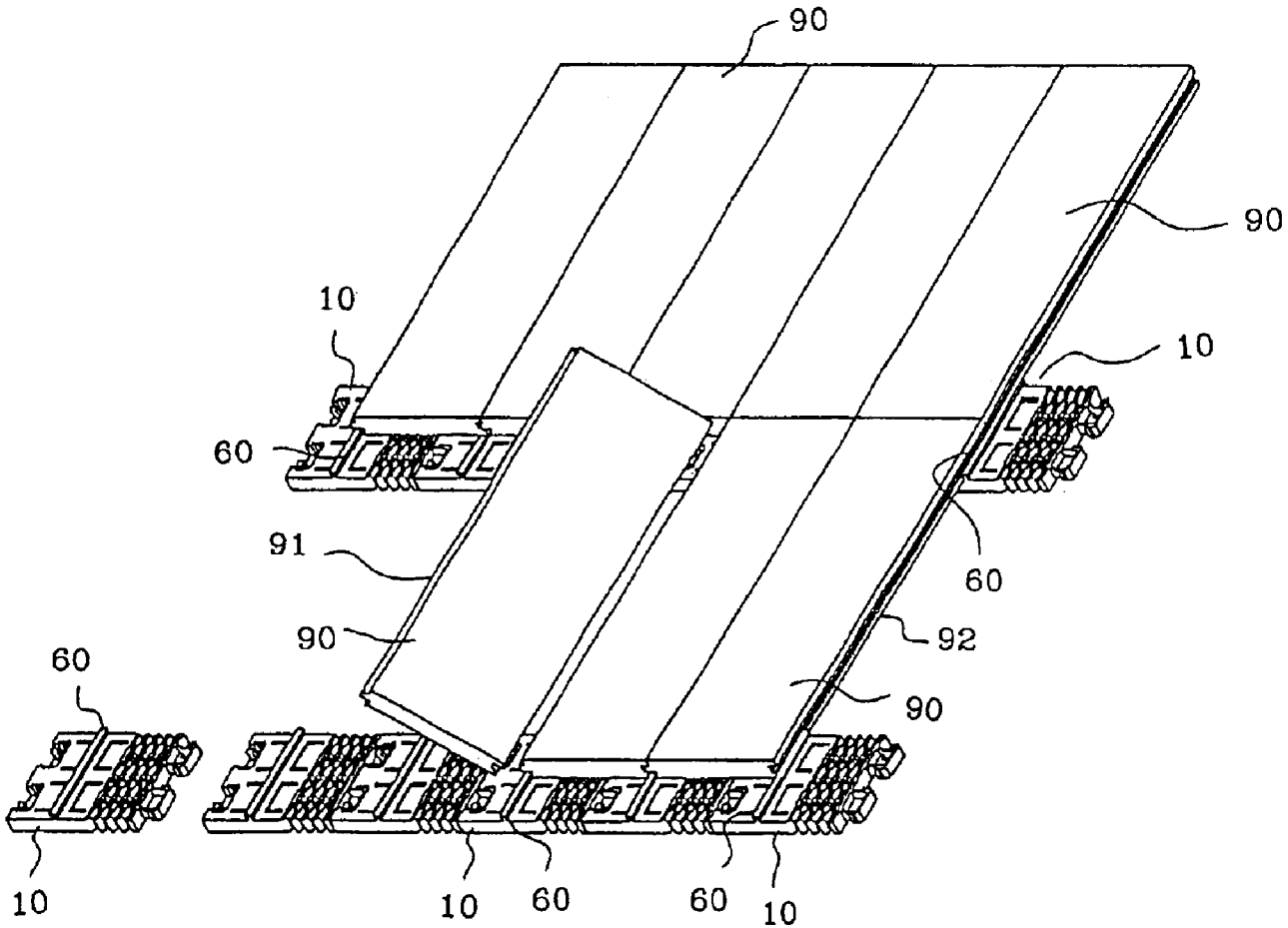
FIG. 5 is an applied view of the present invention.
Figure 6:
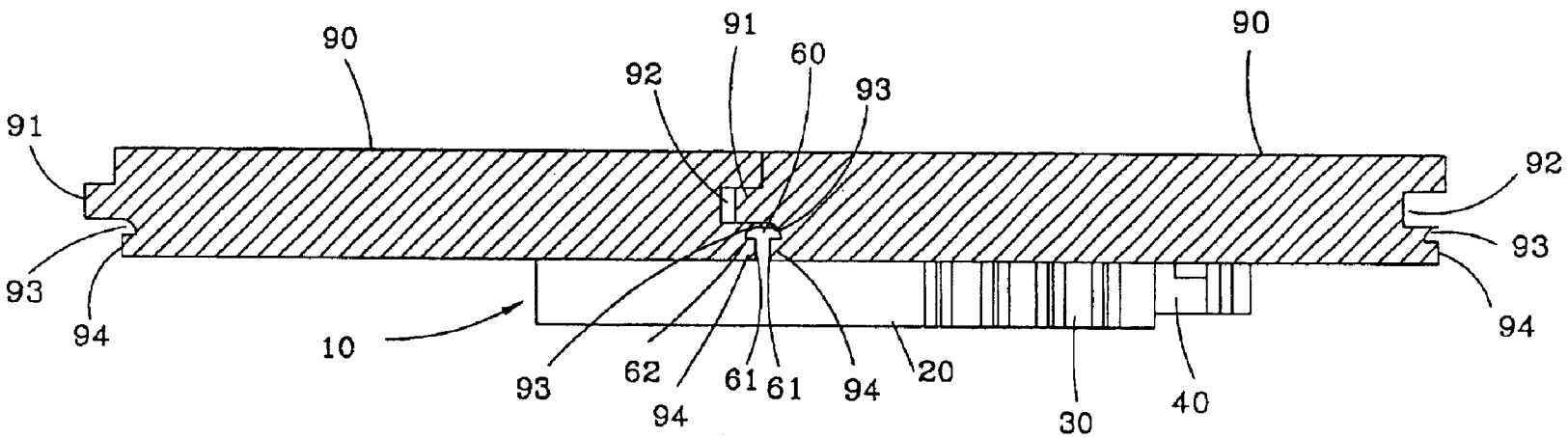
FIG. 6 is side view in section in an enlarged scale of FIG. 5.

Referring to FIGS. 5 and 6, multiple cushion blocks 10 are used with multiple wooden strips 90 to make a wooden flooring. The wooden strips 90 are rectangular strips, each having a longitudinal coupling tongue 91 and a longitudinal coupling groove 92 respectively extended along the two opposite long sides, two longitudinal locating grooves 93 respectively extended along the two opposite long sides below the longitudinal coupling tongue 91 and the longitudinal coupling groove 92, and two longitudinal locating flanges 94 longitudinally disposed in the two opposite long sides below the longitudinal locating grooves 93. The length of each wooden strip 90 is about 1 meter. The maximum width (including the width of the longitudinal coupling tongue 91) of each wooden strip 90 is about 10 cm corresponding to the length of each cushion block 10. The thickness of each wooden strip 90 is about 1.5 cm.

When paving the desired down flooring, arrange multiple cushion blocks 10 into parallel racks 80 at a pitch corresponding to the length of the wooden strips 90, and then mount the wooden strips 90 on each two adjacent racks 80, enabling the two ends of the major axis of each wooden strip 90 to be supported on one half of the area of the top side of a respective cushion block 10 between the retaining devices 60 of two symmetrical pairs of cushion blocks 10. When set into position, the longitudinal coupling tongue 91 of one wooden strip 90 is engaged into the longitudinal coupling groove 92 of another, and the longitudinal locating grooves 93 and longitudinal locating flanges 94 of the wooden strips 90 are respectively forced into engagement with the elongated top flange 62 and elongated coupling grooves 61 of the retaining devices 60 of the cushion blocks 10. Because the cushion blocks 10 are deformable in the linking direction, inserting one wooden strip 90 in between the retaining devices 60 of two cushion blocks 10 causes the two cushion blocks 10 to be reversely expanded outwards in the linking direction for enabling the respective wooden strip 90 to be set into position. When the respective wooden strip 90 set into position, the respective cushion blocks 10 return to their former shape, thereby causing the retaining devices 60 of the respective two cushion blocks 10 to hold down the respective wooden strip 90. Normally, the springy supporting devices 70 of each cushion block 10 have the respective top side partially protruding over the top side of the respective cushion block 10. When the wooden strips 90 pressed on the top side of the cushion blocks 10 are set in position, the springy supporting devices 70 impart an upward pressure to the wooden strips 90, thereby causing the longitudinal locating flanges 94 to be positively stopped against the elongated top flanges 62 of the retaining devices 60 at the bottom side, preventing vibration of the wooden strips 90.

The length and width of the desired wooden flooring may not be able to be divided by the length and width of the wooden strips 90. In this case, the wooden strips 90 for the border area may have to be cut to a particular size. During wooden flooring paving work, the two cushion blocks 10 at the ends of each rack 80 may be cut (for example, along the bottom side of the respective retaining device 60) subject to the cutting status of the bordering wooden strips 90. When abutting one short side of each wooden strip 90 against the wall of the room, the corresponding racks 80 are arranged with one corresponding long side abutted against the wall of the room, thus the corresponding wooden strips 90 can wholly be supported on the corresponding racks 80 without cutting.

FIG. 5 shows simply one wooden flooring paving example according to the present invention. According to this wooden flooring paving example, the wooden strips 90 are longitudinally and transversely aligned. Alternatively, the wooden strips 90 can so arranged that the respective long sides are aligned, and the respective short sides are staggered. Other paving methods as used in the bonding of bricks may be employed. For example, the pitch between two racks 80 can be one half of the length of the wooden strips 90, i.e., three racks 80 are arranged in parallel to support the ends and middle part of the respective wooden strips 90.

The aforesaid example explains the paving of a wooden flooring. However, the invention can also be used in paving any type of the build-up surface, such as bamboo flooring, wooden ceiling, wooden wall panel, etc. When a wooden flooring or wooden ceiling is constructed according to the present invention, elongated open spaces are left in the wooden flooring or wooden ceiling between the wooden strips and the floor or wall surface and between each two adjacent racks for electric wiring.

What is claimed is:

1. A cushion block for using in a build-up surface formed by strips, said cushion block comprising at least one first coupling device at one end thereof, at least one second coupling device at an opposite end thereof corresponding to said at least one first coupling device, said at least one first coupling device and said at least one second coupling device being made such that multiple cushion blocks are connectable in a line in a linking direction by engaging the at least one first coupling device of one cushion block into the at least one second coupling device of another cushion block, a retaining device protruded from one side thereof and adapted to secure at least one of the strips to the corresponding side of the cushion block, and a deformable body connected between said at least one first coupling device and said at least one second coupling device and deformable in said linking direction wherein the cushion block further comprising a flat base; said deformable body extends forwards from one side of said flat base in said linking direction; said at least one first coupling device is respectively extended from one side of said deformable body remote from said base; said at least one second coupling device is respectively formed in said flat base remote from said deformable body; said retaining device is perpendicularly protruded from one side of said flat base.

2. The cushion block as claimed in claim 1, wherein said cushion block is molded from synthetic resin in integrity.

3. The cushion block as claimed in claim 1, wherein said at least one first coupling device is a block-like protruding device protruded from one side of said deformable body; said at least one second coupling device is a recessed coupling device extended to one vertical peripheral side of the cushion block adjacent to one side of said retaining device; the at least one first coupling device of one cushion block is respectively engageable into the at least one second coupling device of another cushion block in the direction of the thickness of the cushion blocks; the at least one first coupling device of a first cushion block is not disengageable from the at least one second coupling device of a second cushion block in said linking direction when the first cushion block and second cushion blocks are connected in a line.

4. The cushion block as claimed in claim 3, wherein said at least one coupling device each comprises a plurality of positioning ribs extending in an outside wall thereof corresponding to the direction of the thickness of said cushion block; said at least one second coupling device each comprises a plurality of positioning grooves extending in an outside wall thereof corresponding to the direction of the thickness of said cushion block, the number of said positioning grooves being greater than said positioning ribs.

5. The cushion block as claimed in claim 3, wherein said at least one first coupling device each has a through hole and a retaining notch at one side of said through hole; said at least one second coupling device each comprises a springy hook, which, when two cushion blocks are connected in a line, is inserted through the through hole of the matching first coupling device and hooked in the retaining notch of the matching first coupling device.

6. The cushion block as claimed in claim 1, wherein said retaining device is an elongated bar disposed perpendicular to said linking direction, having a substantially T-shaped cross section.

7. The cushion block as claimed in claim 1, wherein said deformable body is formed of a latticed grid having rhombic meshes, said rhombic meshes each having two opposite acute angles aligned in a direction across said linking direction, and two opposite obtuse angles aligned in said linking direction.

8. The cushion block as claimed in claim 7, wherein each acute angle of each of said rhombic meshes forms a substantially C-shaped arched portion having an open side facing the inside of the respective rhombic mesh.

9. The cushion block as claimed in claim 1, wherein said base comprises at least two springy supporting devices symmetrically disposed at two sides of said retaining device and adapted to force wooden strips being put on said base at two sides of said retaining device against said retaining device.

10. The cushion block as claimed in claim 9, wherein said one springy supporting devices each comprise a substantially U-shaped crevice formed in the respective side of said base, and a protruding springy tongue formed of a part of said base and defined by said U-shaped crevice, said protruding springy tongue having a fixed end integral with said base and a free end protruding over the corresponding side of said base.

* * * * *